United States Patent [19]

Murata

[11] 4,338,844

[45] Jul. 13, 1982

[54] TONE SOURCE CIRCUIT FOR ELECTRONIC MUSICAL INSTRUMENTS

[75] Inventor: Junya Murata, Shobu, Japan

[73] Assignee: Kabushiki Kaisha Kawai Gakki Seisakusho, Hamamatsu, Japan

[21] Appl. No.: 121,136

[22] Filed: Feb. 13, 1980

[30] Foreign Application Priority Data

| | | | |
|---|---|---|---|
| Feb. 17, 1979 | [JP] | Japan | 54-17665 |
| Feb. 21, 1979 | [JP] | Japan | 54-19249 |
| Feb. 21, 1979 | [JP] | Japan | 54-19250 |

[51] Int. Cl.[3] ..... G10H 1/08; G10H 5/06

[52] U.S. Cl. ..... 84/1.01; 84/1.22; 84/1.23

[58] Field of Search ..... 84/1.01, 1.03, 1.22

[56] References Cited

U.S. PATENT DOCUMENTS

| | | | |
|---|---|---|---|
| 3,610,799 | 10/1971 | Watson | 84/1.01 |
| 3,743,755 | 7/1973 | Watson | 84/1.01 |
| 4,134,321 | 1/1979 | Woron | 84/1.22 |

*Primary Examiner*—S. J. Witkowski

[57] ABSTRACT

A tone source circuit for electronic musical instruments, in which a unit phase coefficient corresponding to a note code required by a key depression is read out from a phase coefficient memory of a tone generating part for each time division channel; the unit phase coefficient is applied to an accumulator composed of an adder and an accumulated value storage register to obtain an accumulated value for each time division channel. A demultiplexer for taking out higher order bits of the accumulated value and supplying them as a sampled rectangular wave signal to a filter provided corresponding to each key, the filter eliminates a sampling pulse component from the sampled rectangular wave, and a mixing circuit then mixes the output from the filters. It is also possible to take out predetermined bits of the accumulated value, store them in a latch circuit for each time division channel and frequency divide the output signal from the latch circuit by a predetermined frequency divider group, providing the frequency divided output as the tone source signal. Also, it is possible to input a rectangular wave sampled pulse signal of a 50% duty ratio from higher order digits of a tone source circuit of an electronic musical instrument to a duty ratio converter composed of AND circuits to output therefrom rectangular wave sampled pulse signals of various duty ratios.

4 Claims, 26 Drawing Figures

BUFFER REGISTER
14-1
MULTIPLEXER
14-2
CHANNEL 1
CHANNEL 2
CHANNEL 15
CHANNEL 16
NC-4
NC-3
NC-2
NC-1
OC-3
OC-2
OC-1
KC-2
KC-1
CL-2 (LSB)
CL-2(1)
CL-2(2)
CL-2 (MSB)
KC-1
KC-2

TONE SOURCE CIRCUIT FOR ELECTRONIC MUSICAL INSTRUMENTS

BACKGROUND OF THE INVENTION

1. Field of the Invention

This invention relates to a tone source circuit for electronic musical instruments which is designed so that a unit phase coefficient corresponding to a note code is read out for each time division channel and accumulated, thereby to simplify the construction of a tone generating part.

2. Description of the Prior Art

A tone source that has been widely employed in electronic musical instruments in the past is such as shown in FIG. 1. A high-frequency clock pulse signal from a main oscillator 1 is frequency divided by a twelve-note frequency divider 2 using frequency ratios respectively corresponding to scales (B to C); the scale pulse outputs are further frequency divided by 1/2 frequency dividers $3_1$ to $3_{12}$ so as to obtain respective octave notes; and these outputs are provided to a gate circuit group 4, in which they are subjected to ON-OFF control by a key depression signal from a key switch 5 and from which they are applied via a tone filter group 6 to a sound system 7.

Such a conventional type of tone source circuit is arranged so that tone source signals of the same number as keys are produced simultaneously; therefore, as will be seen from FIG. 1, it requires an enormous amount of wiring and hence is uneconomical in terms of manufacturing cost and steps involved. In this conventional tone source circuit, the number of notes which can be produced at one time is about twelve at most, so that the frequency dividers and the gate circuits except those used for producing the twelve notes remain idle at that time. Further, the increased amount of wiring poses such a problem that the frequency dividers $3_1$ to $3_{12}$ and the gate circuit group 4 cannot be fabricated as a large scale integrated circuit on account of a limitation on the number of pins used.

To avoid such shortcomings of the prior art, there has been proposed a system for time sharing a small number of common circuits through utilization of the time sharing techniques; however, this system is difficult to apply to such a twelve-note divider and octave divider system as shown in FIG. 1.

SUMMARY OF THE INVENTION

It is an object of this invention to provide a simple-structured tone source circuit for electronic musical instruments.

Another object of this invention is to provide a tone source circuit for electronic musical instruments which is simple in construction and adapted to be capable of producing $2^n$ foot tone and quint note outputs at the same time.

Still another object of this invention is to provide a tone source circuit for electronic musical instruments which is simple in construction and adapted to be capable of producing rectangular sampling waveforms of different duty ratios.

DESCRIPTION OF THE PREFERRED EMBODIMENTS

Figure 1:
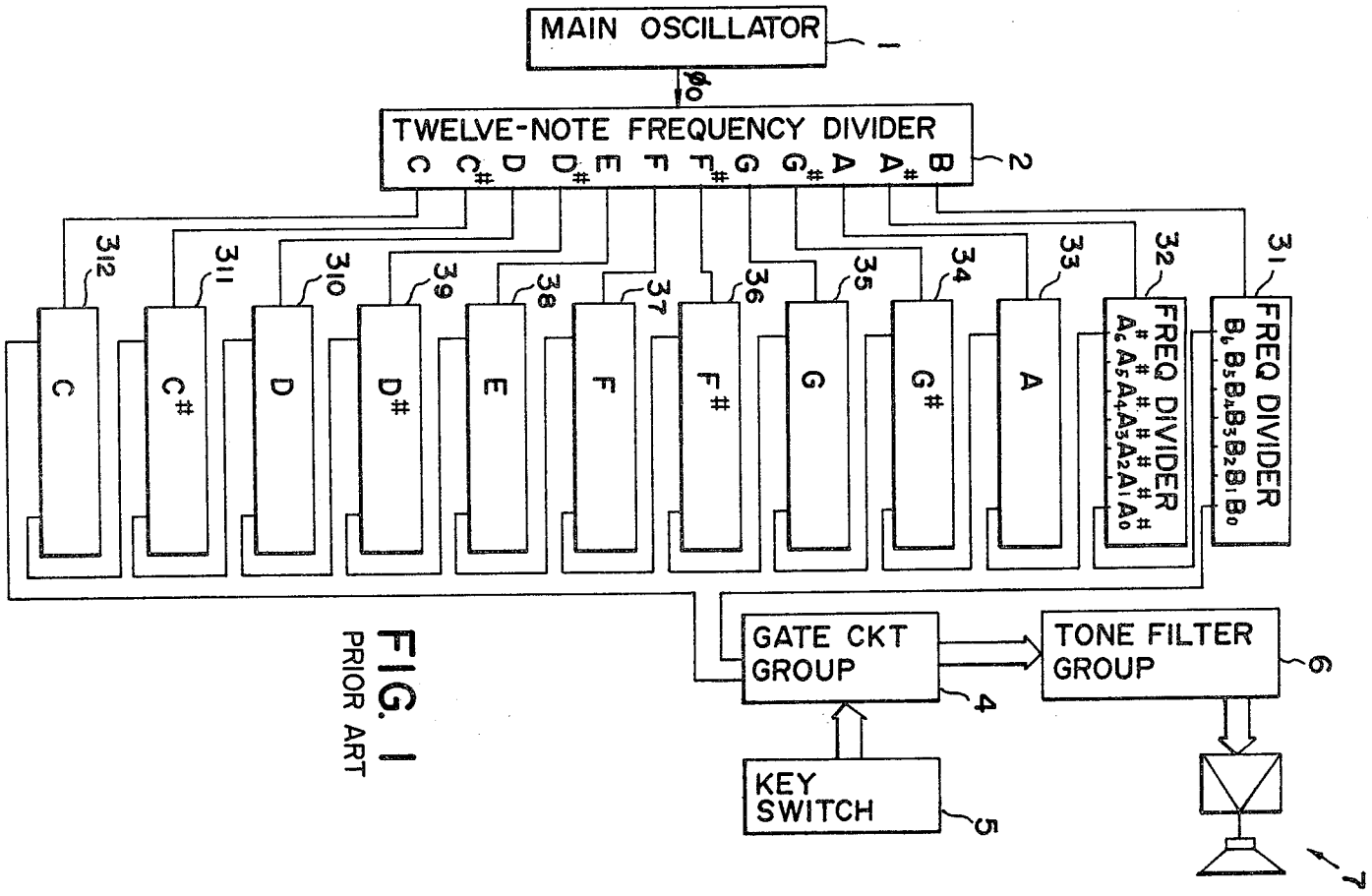
FIG. 1 PRIOR ART
FIG. 1 is a block diagram showing a conventional tone source circuit for electronic musical instruments.
Figure 2:
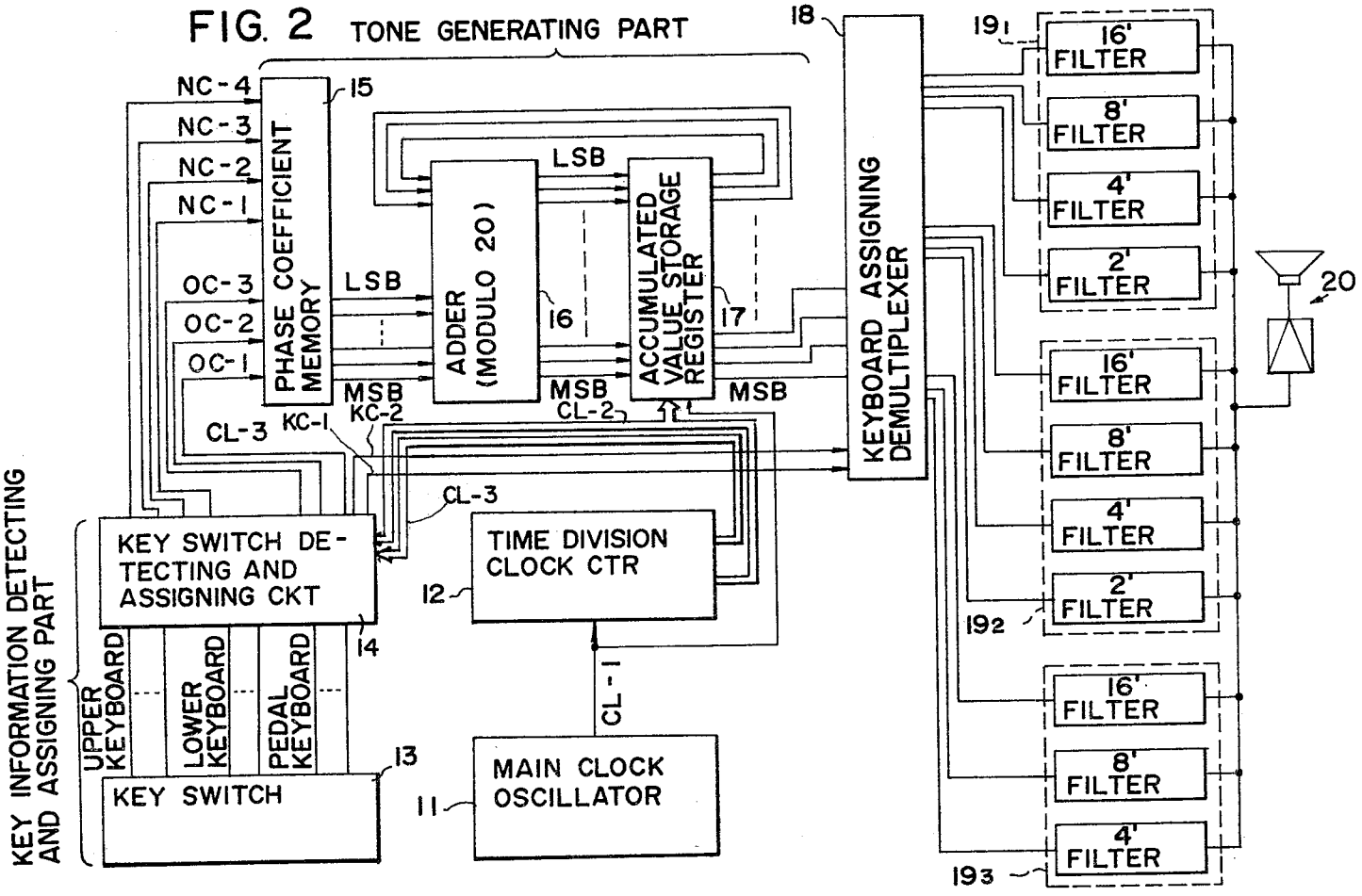
FIG. 2 is a block diagram illustrating an embodiment of the present invention.

In FIG. 2 there is illustrated the arrangement of a first embodiment of this invention. In general, an electronic musical instrument includes an envelope circuit other than those described previously in connection with FIG. 1; but, since the envelope circuit is not essentially related to the construction of the present invention, the envelope circuit is omitted for the sake of brevity. In FIG. 2, a main clock oscillator 11 generates control clock pulses CL-1 necessary for the operation of the entire system. Let it be assumed that the frequency fc of control clock pulses CL-1 is 1 MHz (period Tc=1 μsec.). The main clock pulses CL-1 are applied to a time division control clock counter 12, in which they are appropriately counted and from which are provided a required clock signal CL-3 to a key information detecting and assigning part composed of a key switch 13 and a key switch detecting and assigning circuit 14 and a required channel assignment control clock signal CL-2 to a tone generating part which forms the principal part of the present invention as will be described later and is composed of a phase coefficient memory 15, an adder 16 and an accumulated value storage register 17.

The key switch detecting and assigning circuit 14 is closely related to the tone generating part which is the principal part of this invention. In this embodiment, the key switch detecting and assigning circuit 14 is formed by the keyboard switch detect and assignor proposed in U.S. Pat. No. 4,022,098. As illustrated in FIG. 2, the key switch detecting and assigning circuit 14 receives key information of upper, lower and pedal keyboards from the key switch 13 and provides respective code data, each composed of a note code (NC), an octave code (OC) and a key code (KC), on empty ones of a plurality of channels to which detected key information is assigned on a time division basis. At the synchronized timing by the time division channel control clock signal CL-2 from the time division control clock counter 12, codes NC-1 to NC-4, OC-1 to OC-3 and KC-1 to KC-2 are applied to the tone generating part. In the present embodiment, the number of time division channels in which notes can be produced at the same time is assumed to be sixteen, so that the time division channel control clock signal CL-2 is obtained by frequency dividing the main clock signal CL-1 with a counter of modulo 16 and the respective data codes are assigned to proper time division channels using a multiplexer or the like.

Figure 3:
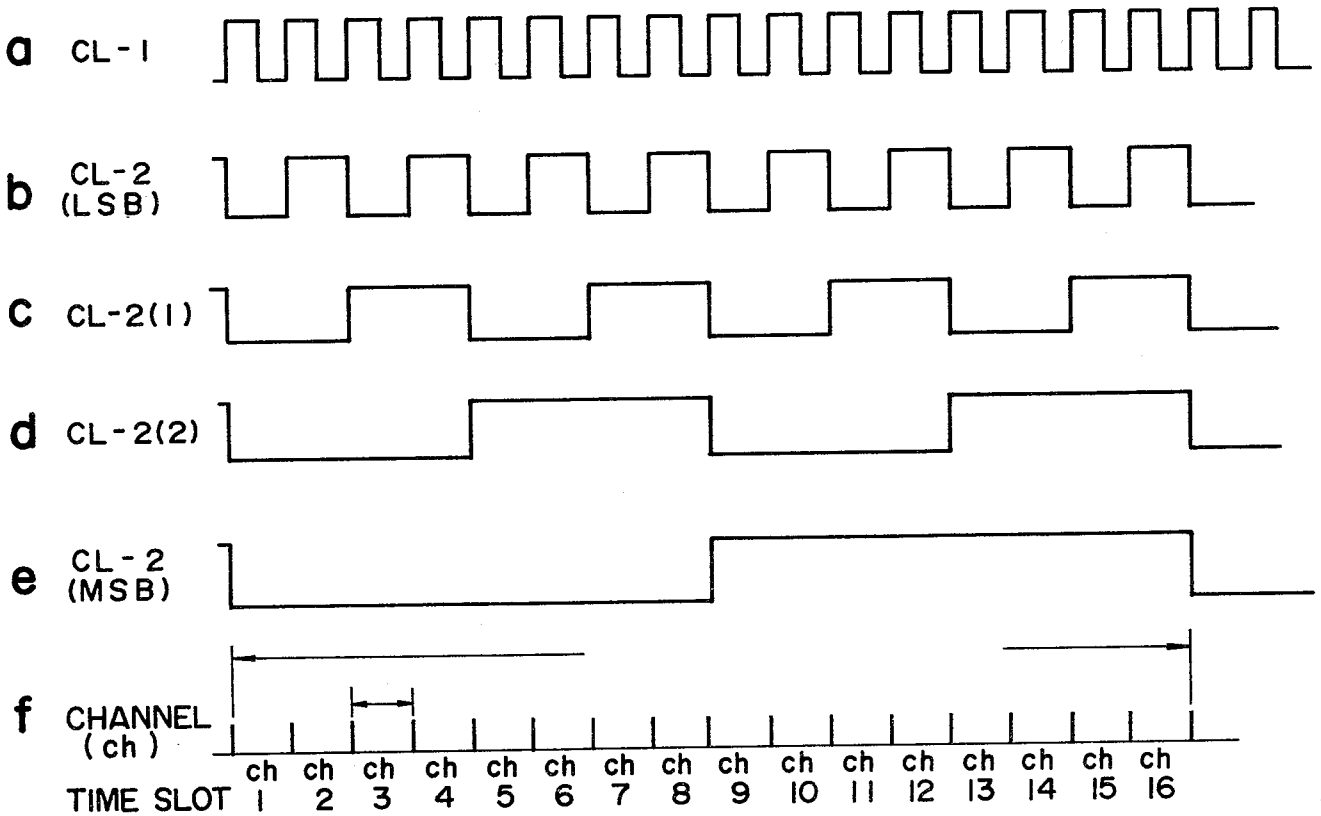
FIG. 3 shows timing charts of respective clock signals in the embodiment of FIG. 2.

FIG. 3 shows timing charts of the respective clock signals; a showing the main clock signal, b to e frequency divided waveforms of the time division channel control clock signal CL-2, and f time division channel slots ch1 to 16 indicated by frequency divided waveforms of the clock signal CL-2.

Figure 4:
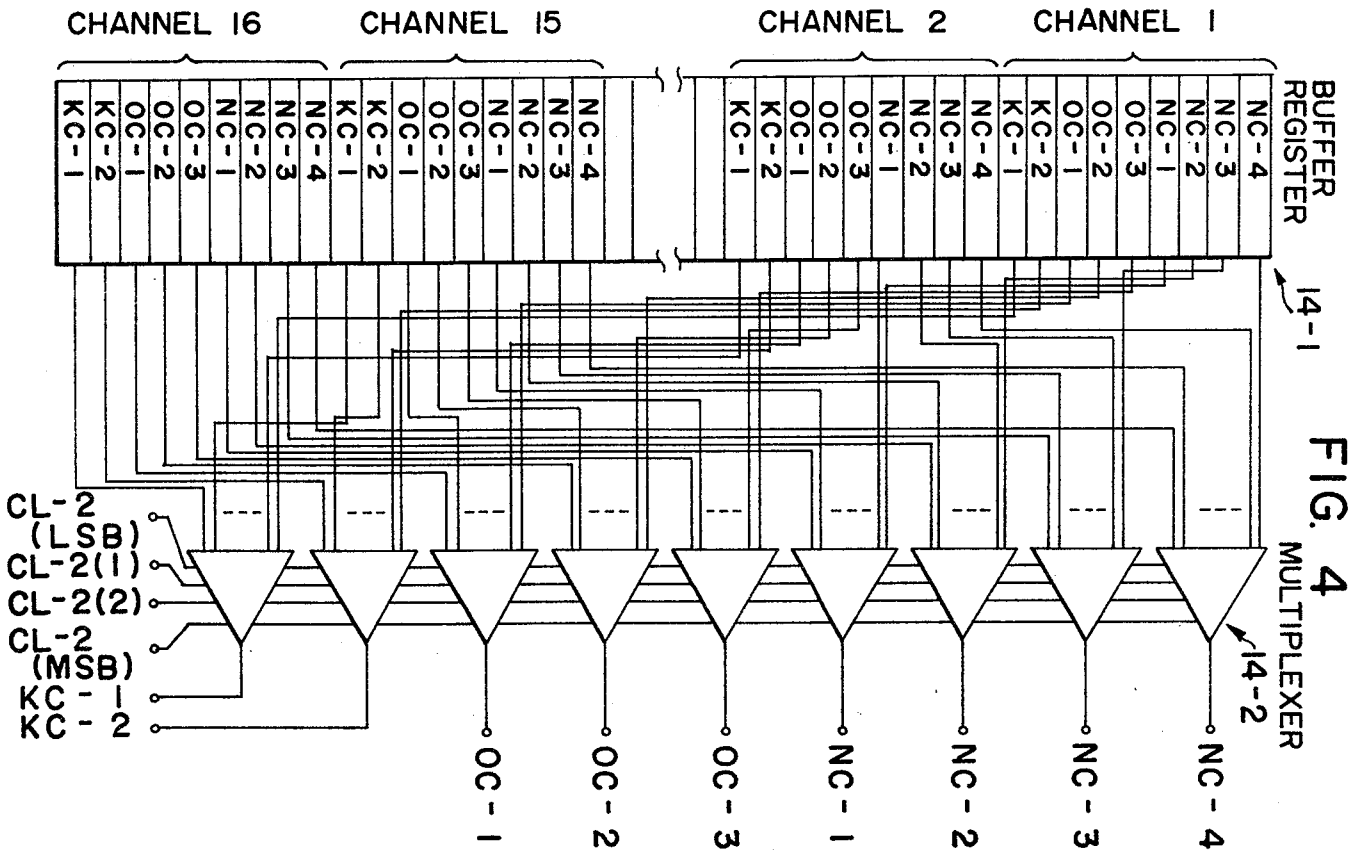
FIG. 4 is a block diagram illustrating an example of a data assignor in a key switch detecting and assigning circuit 14 utilized in the embodiment of FIG. 2.

FIG. 4 illustrates an example of a data assignor which activates a multiplexer using the clock signal CL-2 in the key switch detecting and assigning circuit 14. The sixteen input code data NC-1 to CN-4, OC-1 to OC-3 and KC-1 to KC-2, corresponding to the sixteen channels, are temporarily stored in a buffer register 14-1, whose contents are outputted via a multiplexer 14-2 in the time slots of the respective channels by the clock pulses CL-2 shown in FIGS. 3*b* to *e*.

The tone generating part utilized in the embodiment of FIG. 2 yields time division pulses of a frequency having required accuracy for the musical scale.

Table 1 shows, by way of example, the note codes (NC) and the octave codes (OC) loaded in the buffer register of the key switching detecting and assigning circuit 14. Let it be assumed, for example, that the depression of a key corresponding to a note $C_4$ on the upper keyboard is detected and that the respective key data in Table 1 corresponding to the note $C_4$ are loaded in the channel 1 of the buffer register 14-1 depicted in FIG. 4. At this time, the abovesaid key data is provided in the time slot of a time division multiplex signal which corresponds to the channel 1.

TABLE 1

| Note code | | Octave code (OC) | | Keyboard code (KC) | |
|---|---|---|---|---|---|
| C | 0001 | $C_0 \sim B_0$ | 001 | upper keyboard | 01 |
| C+ | 0010 | $C_1 \sim B_1$ | 010 | lower keyboard | 10 |
| D | 0011 | $C_2 \sim B_2$ | 011 | pedal keyboard | 11 |
| D+ | 0100 | $C_3 \sim B_3$ | 100 | | |
| E | 0101 | $C_4 \sim B_4$ | 101 | | |
| F | 0110 | $C_5$ | 110 | | |
| F+ | 0111 | | | | |
| G | 1000 | | | | |
| G+ | 1001 | | | | |
| A | 1010 | | | | |
| A+ | 1011 | | | | |
| B | 1100 | | | | |

From the phase coefficient memory 15 is read out a unit phase coefficient δ (shown in Table 2) corresponding to the note code (NC) and the octave code (OC) inputted from the key switch detecting and assigning circuit 14, providing a first augend of the adder 16. From the accumulated value storage register 17, the result of an addition carried out before one interval of time division is applied as a second augend to the loop-connected adder 16, and at the same time, the accumulated value storage register 17 stores the addition result from the adder 16. In the manner described above, the adder 16 and the accumulated value storage register 17, make up accumulator in which they operate in association with each other in terms of time.

Figure 5:
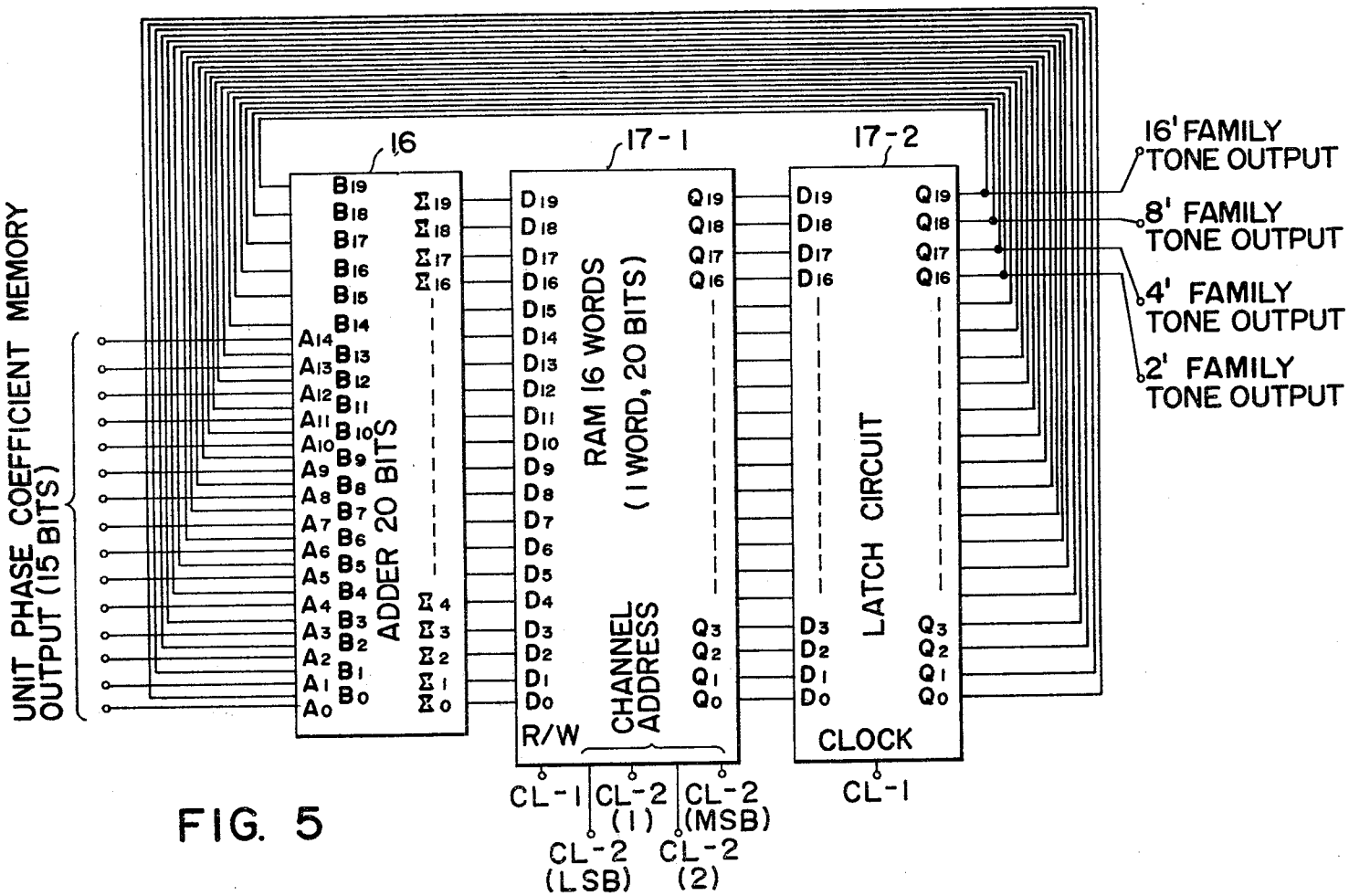
FIG. 5 shows a specific operative example of an accumulator composed of an adder and an accumulated value storage register formed by a random access memory (RAM)
Figure 6:
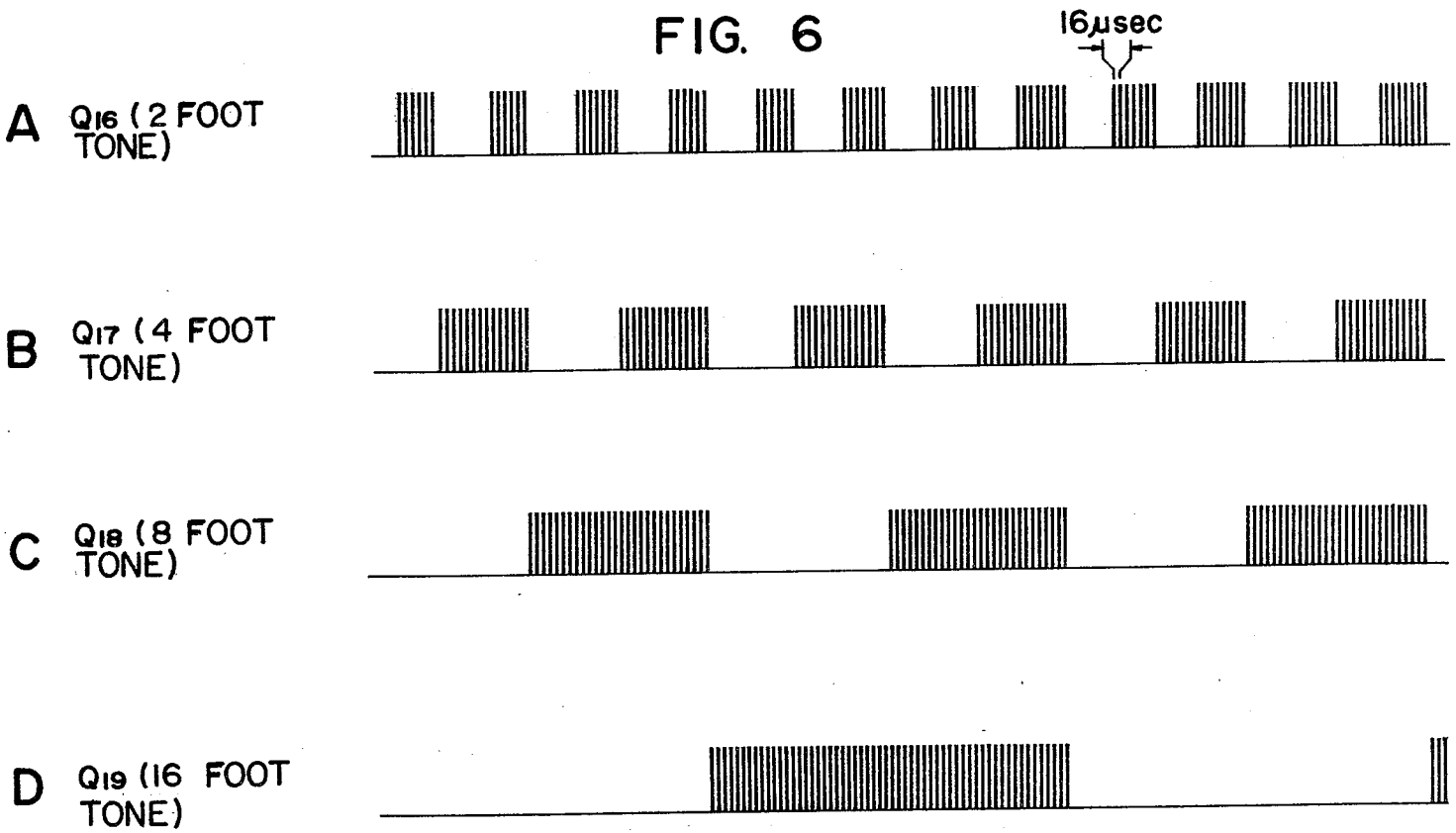
FIGS. 6A to D show output waveforms derived from the accumulator depicted in FIG. 5.
Figure 7:
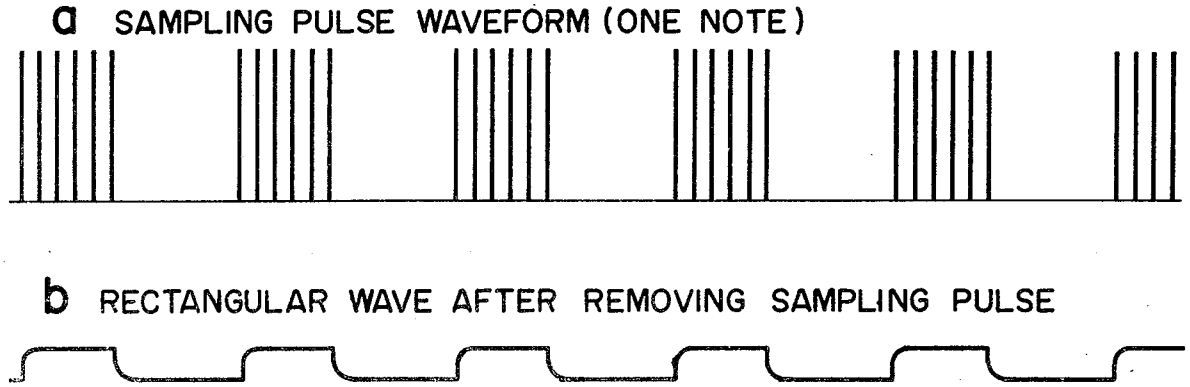
FIGS. 7*a* and *b* respectively show a sampling waveform a in the case of producing only one note and a waveform b after sampling components are removed.

FIG. 5 illustrates a specific operative example of the accumulated value storage register 17 formed by a random access memory (RAM). In FIG. 5, the number of digits of the adder 16 is twenty; this is intended to obtain a frequency accuracy necessary for the scale. With the 20-bit adder 16, when the main clock pulse signal is 1 MHz, a cent error of the scale frequency stays within a range of approximately ±1.5 cents ($C_0$ to $C_5$) at maximum. In this case, the value of the unit phase coefficient δ necessary for obtaining the highest note $C_5$ is represented by fifteen bits, and the first augend input to the adder 16 is $A_0$ to $A_{14}$, the higher order bits $A_{15}$ to $A_{19}$ being idle ("0"). In a predetermined time slot (FIG. 3) designated for each channel, the adder 16 receives the unit phase coefficient δ ($C_4$) from the phase coefficient memory 15, and at the same time, the result of accumulation obtained with the adder 16 one interval before is read out from a RAM 17-1 and once stored in a latch circuit 17-2, thereafter being applied to the adder 16. A read/write (R/W) control signal to the RAM 17-1 represents "read" by "1" and "write" by "0". Address control signals CL-2(LSB) to CL-2(MSB) of the RAM 17-1 hold address values corresponding to the predetermined channel throughout the period during which the RAM read-out, the addition and the write of the addition result, described above, are performed; namely, the RAM 17-1 completes the read/write operation within one time slot.

Now, the operation will be described in connection with a signal of the frequency corresponding to the note $C_4$ on the upper keyboard. Let it be assumed that at the start of generation of the note, the predetermined channel of the RAM 17-1 is reset to an initial value 0. At this time, occurrence of the note $C_4$ is indicated by the key switch detecting and assigning circuit 14, and in the time slot corresponding to the channel 1, the phase coefficient δ ($C_4$) is read out from the phase coefficient memory 15. The value of the phase coefficient δ ($C_4$), 8779="010001001001011", is added by the adder 16 every interval, and the accumulated values are sequentially stored in the RAM 17-1. At this time, output pulses from outputs $Q_{11}$ to $Q_{19}$ of the latch circuit 17-2 assume such waveforms as shown in FIGS. 6A to D, respectively. The outputs are each represented by a pulse group corresponding to a rectangular wave; if the output $Q_{16}$ is assumed to correspond to a feet ratio 2' (feet), the outputs $Q_{17}$ to $Q_{19}$ respectively correspond to 4', 8' and 16'. As will be seen from the waveforms shown in FIGS. 6A to D, the waveform generation system adopted in the present invention is equivalent to such a waveform storage system in which a frequency number R is periodically accumulated and a rectangular wave is read out from a rectangular waveform memory using the accumulated values as addresses. In the present invention, however, such rectangular waveform memory is unnecessary and the accumulated values are applied directly to the keyboard assigning demultiplexer 18.

The above has described the procedure for producing the note $C_4$ alone, but a plurality of notes can be produced simultaneously by the employment of the time division multiplex techniques. That is to say, in the present invention, sixteen notes can be generated simultaneously and the note corresponding to the key being depressed is assigned to the time slot corresponding to an empty channel.

Next, a description will be given of the keyboard assigning demultiplexer 18 and the arrangement following it. Usually, an electronic organ is equipped with a plurality of keyboards, such as upper, lower and pedal keyboards, and these keyboards produce mere tones in many cases. In contrast thereto, in the present invention, the key code signals KC-1 and KC-2 from the key switch detecting and assigning circuit 14 are provided to the keyboard assigning demultiplexer 18, whose output is divided into three groups of the upper, lower and pedal keyboards, as shown in FIG. 2. The outputs from the upper and lower keyboards are applied to tone filters $\mathbf{19}_1$ and $\mathbf{19}_2$, each composed of feet ratios 2', 4', 8' and 16', and the output from the pedal keyboard is applied to a tone filter $\mathbf{19}_3$ composed of filters of feet ratios 4', 8' and 16'. The notes outputted from the filters in the respective time division time slots are mixed together and supplied to a sound system 20.

The following will describe the relationship between the unit phase coefficient $\delta$ and the note frequency in the tone generating part which is the principal part of this invention.

The adder 16 of the tone generating part is N-bit. With an N-bit binary number, it is possible to express positive integers up to 0 to $2^N$-1. Now, letting the $2^N$ positive integers be represented by W, it follows that $$W=2^N \quad (1)$$

In the adder 16, the unit phase coefficient $\delta$ is added for each unit time $t_0=16$ μsec., and by the action of the accumulated storage register 17, the adder value is accumulated. At this time, the most significant bit (MSB) of the accumulated value is "0" or "1" in dependence on whether the accumulated value is below $(2^N/2)$ or above $(2^N/2)+1$. That is to say, the change in the most significant bit that takes "0" or "1" corresponding to the integers 0 to $2^N-1$ corresponds to a sampling pulse of one period ($2\pi$) of a rectangular wave and is expressed by W in the abovesaid expression (1).

Letting the change in the most significant bit be represented by a unit clock pulse frequency $f_0$, its period $T_0$ be represented by the numerical value W and the note frequency be represented by $f_T$, the unit phase coefficient $\delta$ for obtaining the note corresponding to the key being depressed is a numerical value given by the following expression:

$$\delta = W\frac{f_T}{f_0} \quad (2)$$

This numerical value represents the amount of phase of the note frequency $f_T$ corresponding to the amount of phase for one period of the unit clock pulse frequency $f_0$.

Table 2 shows the unit phase coefficient $\delta$ obtained for each note frequency $f_T$ by substituting the expression (1) into the expression (2):

$f_0=62500$ Hz ($T_0=16$ μsec.)

$W=2^N=2^{20}=1048576$

In Table 2, with respect to the notes A(0) to B(0), C(0) to B(1), . . . C(4) to B(5) and C(5), $f_T$ is each note frequency (a true value), $\delta$ is the unit phase coefficient value obtained from $f_T$ by the expression (2) and $\delta'$ is a value of only the integer part of $\delta$ obtained by counting its fractions of 0.5 and over as a whole number and disragarding the rest. $f'_T$ is each note frequency obtained by accumulating $\delta'$ and is obtained by the following expression:

$$f'_T=f_0\times(\delta'/W) \quad (3)$$

TABLE 2

| twelve notes $f_T$ (true value) | $\delta$ | $\delta'$ | $f'_T$ (accumulated value) | cent error |
|---|---|---|---|---|
| A(0) = 27.500 | 461.37 | 461 | 27.478 | −1.403 |
| A+(0) = 29.135 | 488.81 | 489 | 29.147 | 0.680 |
| B(0) = 30.868 | 517.87 | 518 | 30.875 | 0.418 |
| C(0) = 32.703 | 548.67 | 549 | 32.723 | 1.045 |
| C+(0) = 34.648 | 581.29 | 581 | 34.630 | −0.874 |
| D(0) = 36.708 | 615.86 | 616 | 36.716 | 0.395 |
| D+(0) = 38.891 | 652.48 | 652 | 38.862 | −1.274 |
| E(0) = 41,203 | 691.28 | 691 | 41.187 | −0.700 |
| F(0) = 43.654 | 732.38 | 732 | 43.631 | −0.909 |
| F+(0) = 46.249 | 775.93 | 776 | 46.253 | 0.144 |
| G(0) = 48.999 | 822.07 | 822 | 48.995 | −0.156 |
| G+(0) = 51.913 | 870.96 | 871 | 51.916 | 0.087 |
| A(1) = 55.000 | 922.75 | 923 | 55.015 | 0.475 |
| A+(1) = 58.270 | 977.62 | 978 | 58.293 | 0.680 |
| B(1) = 61.735 | 1035.75 | 1036 | 61.750 | 0.422 |
| C(1) = 65.406 | 1097.34 | 1097 | 65.386 | −0.532 |
| C+(1) = 69.296 | 1162.59 | 1163 | 69.320 | 0.616 |
| ′ (1) = 73.416 | 1231.72 | 1232 | 73.433 | 0.395 |
| ′ (1) = 77.782 | 1304.96 | 1305 | 77.784 | 0.053 |
| ′ (1) = 82.407 | 1382.56 | 1383 | 82.433 | 0.551 |
| ′ (1) = 87.307 | 1464.77 | 1465 | 87.321 | 0.274 |
| ′ (1) = 92.499 | 1551.87 | 1552 | 92.506 | 0.148 |
| ′ (1) = 97.999 | 1644.15 | 1644 | 97.990 | −0.156 |
| ′ (1) = 103.826 | 1741.91 | 1742 | 103.831 | 0.087 |
| (2) = 110.000 | 1845.49 | 1845 | 109.971 | −0.464 |
| (2) = 116.541 | 1955.23 | 1955 | 116.527 | −0.205 |
| B(2) = 123,471 | 2071.49 | 2071 | 123.441 | −0.414 |
| C(2) = 130.813 | 2194.67 | 2195 | 130.832 | 0.259 |
| C+(2) = 138.591 | 2325.17 | 2325 | 138.581 | −0.129 |
| ′ (2) = 146.832 | 2463.44 | 2463 | 146.806 | −0.304 |
| ′ (2) = 155.563 | 2609.92 | 2610 | 155.568 | 0.053 |
| ′ (2) = 164.814 | 2765.11 | 2765 | 164.807 | −0.072 |
| ′ (2) = 174.614 | 2929.54 | 2930 | 174.642 | 0.274 |
| ′ (2) = 184.997 | 3103.74 | 3104 | 185.013 | 0.148 |
| ′ (2) = 195.998 | 3288.29 | 3288 | 195.980 | −0.156 |
| ′ (2) = 207.652 | 3483.82 | 3484 | 207.663 | 0.087 |
| ′ (3) = 220.000 | 3690.99 | 3691 | 220.001 | 0.008 |
| ′ (3) = 233.082 | 3910.46 | 3910 | 233.054 | −0.205 |
| B(3) = 246.941 | 4142.99 | 4143 | 246.942 | 0.004 |
| C(3) = 261.625 | 4389.34 | 4389 | 261.605 | −0.133 |
| C+(3) = 277.182 | 4650.34 | 4650 | 277.161 | −0.129 |
| ′ (3) = 293.664 | 4926.87 | 4927 | 293.672 | 0.046 |
| ′ (3) = 311.127 | 5219.84 | 5220 | 311.136 | 0.053 |
| ′ (3) = 329.627 | 5530.23 | 5530 | 329.614 | −0.072 |
| ′ (3) = 349.228 | 5859.07 | 5859 | 349.223 | −0.027 |
| ′ (3) = 369.994 | 6207.47 | 6207 | 369.966 | −0.133 |
| ′ (3) = 391.995 | 6576.59 | 6577 | 392.020 | 0.110 |
| ′ (3) = 415.304 | 6967.64 | 6968 | 415.325 | 0.087 |
| ′ (4) = 440.000 | 7381.97 | 7382 | 440.001 | 0.008 |
| ′ (4) = 466.163 | 7820.92 | 7821 | 466.168 | 0.019 |
| B(4) = 493.882 | 8285.97 | 8286 | 493.884 | 0.008 |
| C(4) = 523.250 | 8778.68 | 8779 | 523.269 | 0.061 |
| C+(4) = 554.365 | 9300.70 | 9301 | 554.383 | 0.053 |
| ′ (4) = 587.329 | 9853.75 | 9854 | 587,344 | 0.046 |
| ′ (4) = 622.253 | 10439.68 | 10440 | 622.272 | 0.053 |
| ′ (4) = 659.254 | 11060.45 | 11060 | 659.227 | −0.072 |
| ′ (4) = 698.456 | 11718.14 | 11718 | 698.447 | −0.023 |
| ′ (4) = 739,989 | 12412.95 | 12415 | 739.991 | 0.008 |
| ′ (4) = 783.990 | 13153.17 | 13153 | 783.980 | −0.023 |
| ′ (4) = 830.608 | 13935.29 | 13935 | 830.591 | −0.034 |
| ′ (5) = 880.000 | 14763.94 | 14764 | 880.003 | 0.008 |
| ′ (5) = 923.326 | 15641.84 | 15642 | 932.336 | 0.019 |
| B(5) = 987.765 | 16571.95 | 16572 | 987.768 | 0.008 |
| C(5) = 1046.501 | 17557.37 | 17557 | 1046.479 | −0.038 |

In the above, the most significant bit is considered; in the case of accumulating the constant augend $\delta'$ using the adder 16, each bit larger than $\delta'$ varies at a frequency twice as high as that of a bit more significant than the above bit by one order. By utilizing such nature, notes of different feet ratios can easily be produced.

In Table 2, the frequency of 16 feet tones is derived from $f'_T$ (the accumulated value) through utilization of the most significant bit; but if the bit less significant than the most significant one by one order is used, the frequency of 8-feet tones ($2f'_T$) is obtained, and if a bit less significant than the above bit by one order is used, the frequency of 4-feet tones is obtained. In this manner, the feet ratio can be selected with much ease, and as described previously, the outputs of respective feet ratios can be derived from the higher order bits of the latch circuit.

Thus, the feet ratio can easily be selected by the selection of the bits, but the limit of such selection is up to the bit immediately above the bit necessary for the expression of the maximum value of the unit phase coefficient $\delta$. In other words, in order to obtain a rectangular wave of one period with the number of words W corresponding to a certain number of bits N, the number of bits of the unit phase coefficient $\delta$ must be N-1 or less.

The rectangular wave pulse generation by the use of the time division multiplex system according to the present invention is equivalent in function to the system which stores a rectangular waveform in a memory and reads it out on the time division basis, as referred to previously. In general, however, in the case of reading out the stored rectangular waveform as a time division signal and reproducing it, the sampling pulse must be removed. Also in this invention, the sampling pulse must be removed; the following will describe the removal of the sampling pulse component.

According to the principles of sampling, a sample waveform is sampled by sampling pulses of a frequency twice or more as high as the highest harmonic of the waveform. In this case, such conditions are applied that the original sample waveform can be faithfully reproduced by subsequently removing the sampling pulse component as by a low-pass filter. The highest frequency of the note needed in this invention is the frequency of the note $C_5$. The frequency of this note is 1046.5 Hz in the 16 foot tone but 8372 Hz in the 2 foot tone.

The period of the sampling pulse in the present invention corresponds to one interval of time division ($T_0$=16 sec., $f_0$=62500 Hz), as shown in FIGS. 3 and 4. It must be noted here that 1 $\mu$sec. of one time slot is the channel switching period for time division multiplexing, not the sampling period.

The sampling frequency 62500 Hz is 7.5 times as high as the abovesaid highest frequency 8372 Hz and hence is sufficiently high. Accordingly, by a simple low-pass filter having a cutoff frequency in the vicinity of the highest frequency 8372 Hz and a cutoff characteristic of a 12 dB attenuation per octave, the sampling pulse component is attenuated more than 30 dB and is almost removed.

In the embodiment of FIG. 2, the tone filters $\mathbf{19}_1$ to $\mathbf{19}_3$ are employed, and in many cases, they constitute low-pass filters, each having a lower cutoff frequency corresponding to each note, so that the sampling pulse component can be removed more satisfactorily.

FIGS. *7a* and *b* respectively show a sample waveform a for producing only one note and a waveform b after removing the sampling pulse component.

Figure 8:
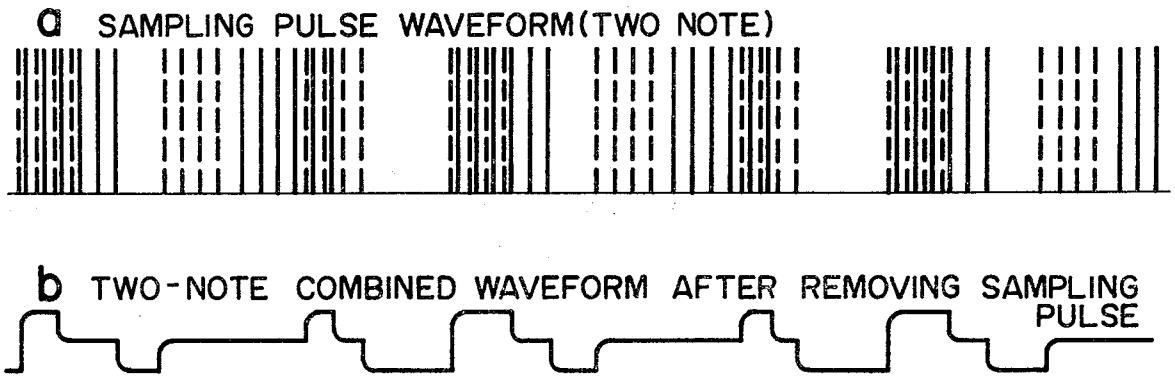
FIGS. 8*a* and *b* respectively show a two-note sampling waveform a composed of a frequency $f_T$ indicated by the solid line and a frequency 1.5 $f_T$ indicated by the broken line, and a two-note composite waveform b after sampling components are removed.

FIGS. 8*a* and *b* respectively show a two-note sample waveform a composed of a frequency $f_T$ indicated by the solid line and a frequency 1.5 $f_T$ indicated by the broken, and a two-note composite waveform after removing the sampling pulse component. Thus, it will be seen that after the removal of the sampling pulse, the waveform reproduced by the time division multiplex method is equivalent to a composite waveform of a plurality of signal waves, obtained by an ordinary analog adder.

As described above, in accordance with the first embodiment of the present invention, a unit phase coefficient is read out, for each time division channel, from a phase coefficient memory of a tone generating part corresponding to a note code required by a key depression, and the unit phase coefficient is applied as an augend to an accumulator composed of an adder and an accumulated value storage register to obtain an accumulated value for each time division channel. A demultiplexer for taking out higher order bits of the accumulated value and supplying them as a sampled rectangular wave signal to a filter provided corresponding to each key, the filter eliminates a sampling pulse component from the sampled rectangular wave, and a mixing circuit them mixes the output from the filters. This prevents that some of the circuits used are idle as described previously with regard to FIG. 1. Furthermore, the output from the accumulator is provided directly to the multiplexing output device without reading a rectangular wave memory, so that although a slight level drop occurs, the entire arrangement is substantially simplified and the number of input/output pins is also reduced, thus making it possible to obtain an electronic musical instrument easy to fabricate as a large scale integrated circuit.

In the first embodiment of this invention, the unit phase coefficient corresponding to each note code of a key is loaded in the phase coefficient memory of the tone generating part and read out and accumulated by the accumulator for each time division channel, and the higher order bits of the accumulated value are taken out and applied to. A demultiplexer for taking out higher order bits of the accumulated value and supplying them as a sampled rectangular wave signal to a filter provided corresponding to each key, the filter eliminates a sampling pulse component from the sampled rectangular wave, and a mixing circuit them mixes the output from the filters. This system has the advantage that the arrangement of the tone generating part is markedly simplified. However, since the higher order bits of the binary code of the accumulated value are taken out, only the output of the $2^n$ foot tones tone is available but it is difficult to obtain the output of the quint notes at the same time. Moreover, since the first embodiment employs the method that the rectangular wave pulse is shaped directly from the sample waveform, there are posed problems of the removal of the sampling pulse and the lowering of the level of the rectangular wave pulse.

A second embodiment of the present invention which will hereinbelow be described is intended to provide a tone source for electronic musical instruments which is adapted to yield the outputs of the $2^n$-foot tones and the quint notes at the same time.

Figure 9:
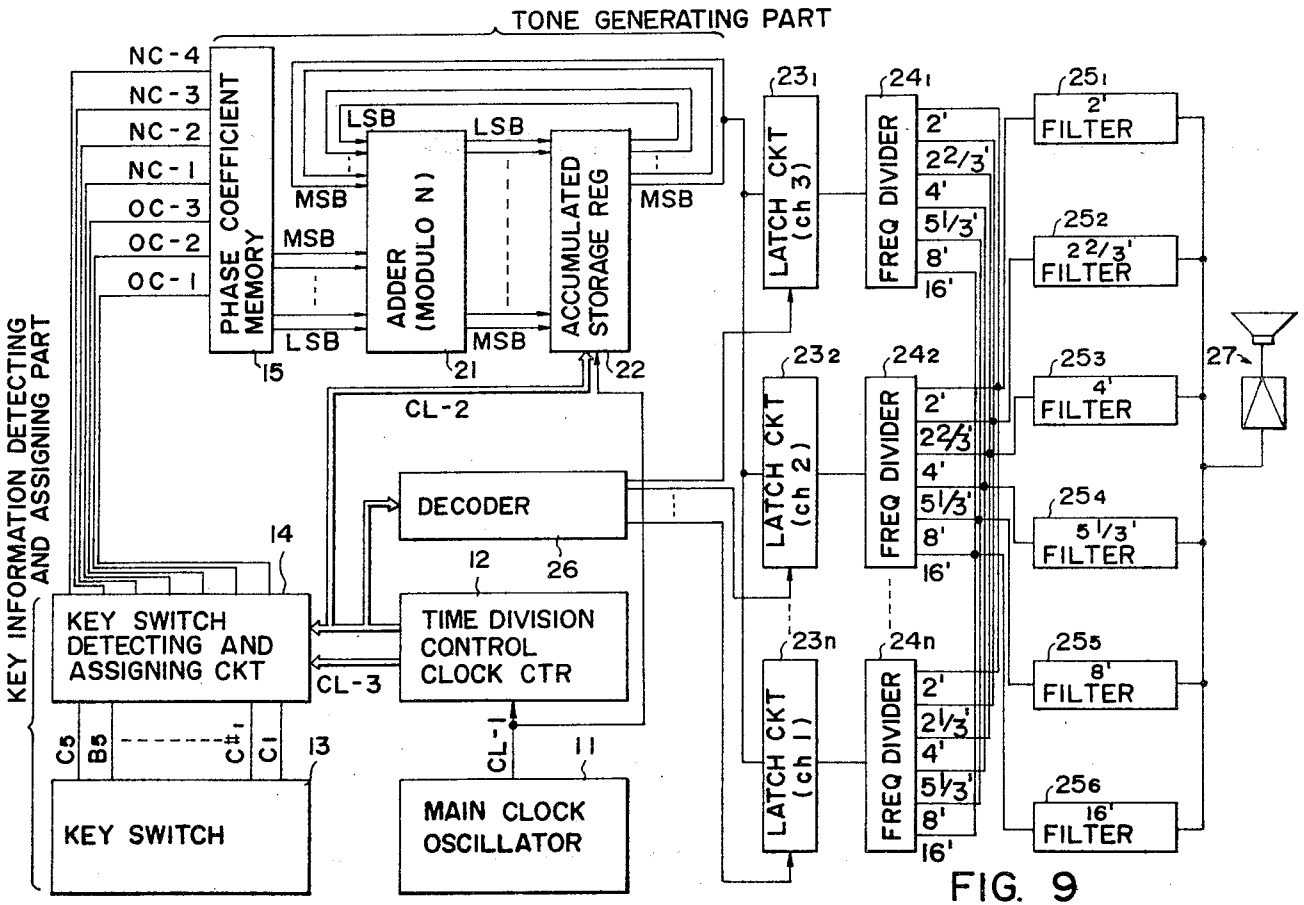
FIG. 9 is a block diagram illustrating the arrangement of another embodiment of this invention.
Figure 10:
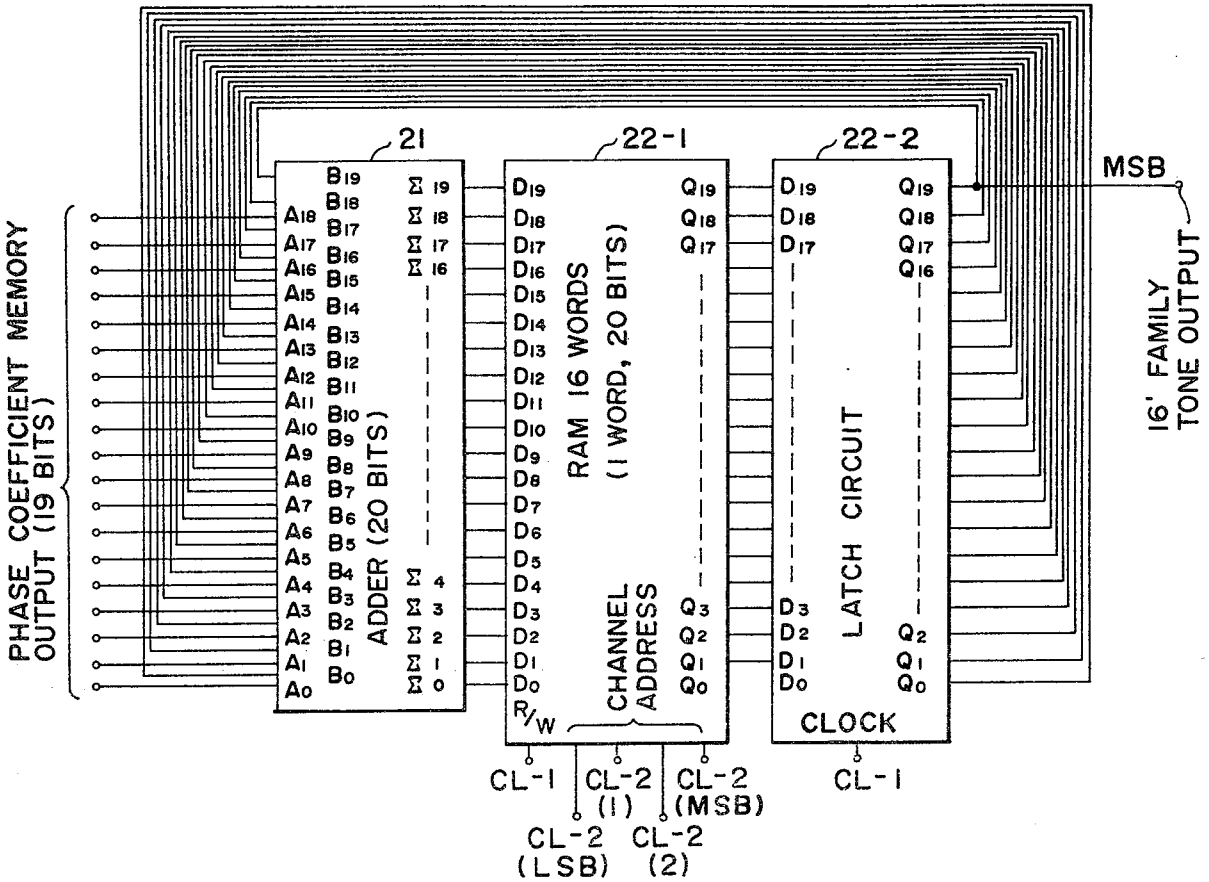
FIG. 10 shows a specific operative example of an accumulator employed in the embodiment of FIG. 9.

FIG. 9 illustrates the arrangement of the second embodiment of the present invention, but the envelope circuit part is omitted for the sake of simplicity. In FIG. 9, the key information detecting and assigning part is the same as described above in respect of FIG. 2. In the tone generating part, an adder 21 and an accumulated value storage register 22 constitute an accumulator in which they operate in association with each other in terms of time. The accumulator used in this embodiment is shown in FIG. 10. With the circuit arrangement of FIG. 5 in which the accumulator employs a random access memory (RAM) as the accumulated value storage register, the selection of the feet ratio is effected by the selection of the higher order bits of the latch circuit, so that the $2^n$-foot tones of, for example, 16', 8', 4', 2' and 1', can be easily obtained, but it is difficult in principles to simultaneously generate the quint notes of $2\frac{2}{3}'$ and $5\frac{1}{3}'$. It is also possible that a tone generating part for the quint notes which has a frequency three times higher than the $2^n$-foot tones is provided separately of the tone generating part for the $2^n$-foot tones, but this excessively increases the scale of the arrangement.

In the second embodiment, in order to obtain the $2^n$-foot tones and the quint notes at the same time, the value of the unit phase coefficient which is stored in the phase coefficient memory 15 in FIG. 9 is selected different from the value of the unit phase coefficient $\delta$ shown by the expression (2). In the present embodiment, the unit phase coefficient is represent by $\delta_1$ relative to the unit phase coefficient $\delta$ of the expression (2), as follows:

$$\delta_1 = 3.2^3 = 24\delta \quad (4)$$

Table 3 shows this value corresponding to each note frequency $f_T$. This value is loaded in the phase coefficient memory 15. The accumulator is constructed as shown in FIG. 10. The embodiment of FIG. 9 differs from the embodiment of FIG. 5 in the following point: In accordance with the expression (4), nineteen bits corresponding to the highest note $C_5$ in Table 3 are provided from the phase coefficient memory 15 to the 20-bit adder 21, and only the most significant bit, i.e. only the 16-foot tone output is taken out from a latch circuit 22-1; and on the basis of this output, the $2^n$-foot tones and the quint tone are obtained by a combination of latch circuits and frequency dividers of the subsequent stage.

TABLE 3

| Note $f_T$ | $\delta_1$ | Note $f_T$ | $\delta_1$ |
|---|---|---|---|
| C(0) = 32.703 | 13168 | C(4) = 523.250 | 210688 |
| C+(0) = 34.648 | 13951 | C+(4) = 554.365 | 223217 |
| D(0) = 36.708 | 14781 | D(4) = 587.329 | 236490 |
| D+(0) = 38.891 | 15660 | D+(4) = 622.253 | 250552 |
| E(0) = 41.203 | 16591 | E(4) = 659.254 | 265451 |
| F(0) = 43.654 | 17577 | F(4) = 698.456 | 281235 |
| F+(0) = 46.249 | 18622 | F+(4) = 739.989 | 297959 |
| G(0) = 48.999 | 19730 | G(4) = 783.990 | 315676 |
| G+(0) = 51.913 | 20903 | G+(4) = 830.608 | 334447 |
| A(1) = 55.000 | 22146 | A(5) = 880.000 | 354335 |
| A+(1) = 58.270 | 23463 | A+(5) = 932,326 | 375404 |
| B(1) = 61.735 | 24858 | B(5) = 987.765 | 397727 |
| C(1) = 65.406 | 26336 | C(5) = °1046.501 | 421377 |
| C+(1) = 69.296 | 27902 | | |

Turning back to FIG. 9, as described previously, the unit phase coefficient $\delta_1$ corresponding to a predetermined note frequency $f_T$ in Table 3 is read out from the phase coefficient memory 15 and its accumulated value is latched in the latch circuit 22-2 of the accumulated value storage register shown in FIG. 10, and then the 16-foot tone output which is the most significant bit output of the latch circuit 22-2 is applied to and latched in latch circuits $23_1$ to $23_n$, each formed by a D flip-flop and corresponding to one of the channels. To strobe terminals (T) of the latch circuits $23_1$ to $23_n$ are applied sequence pulses from a decoder 26 which decodes the clock pulses CL-2 from the time division control clock counter 12, by which the most significant bit output is latched in assigned channels and provided to frequency dividers $24_1$ to $24_n$, respectively.

Figure 11:
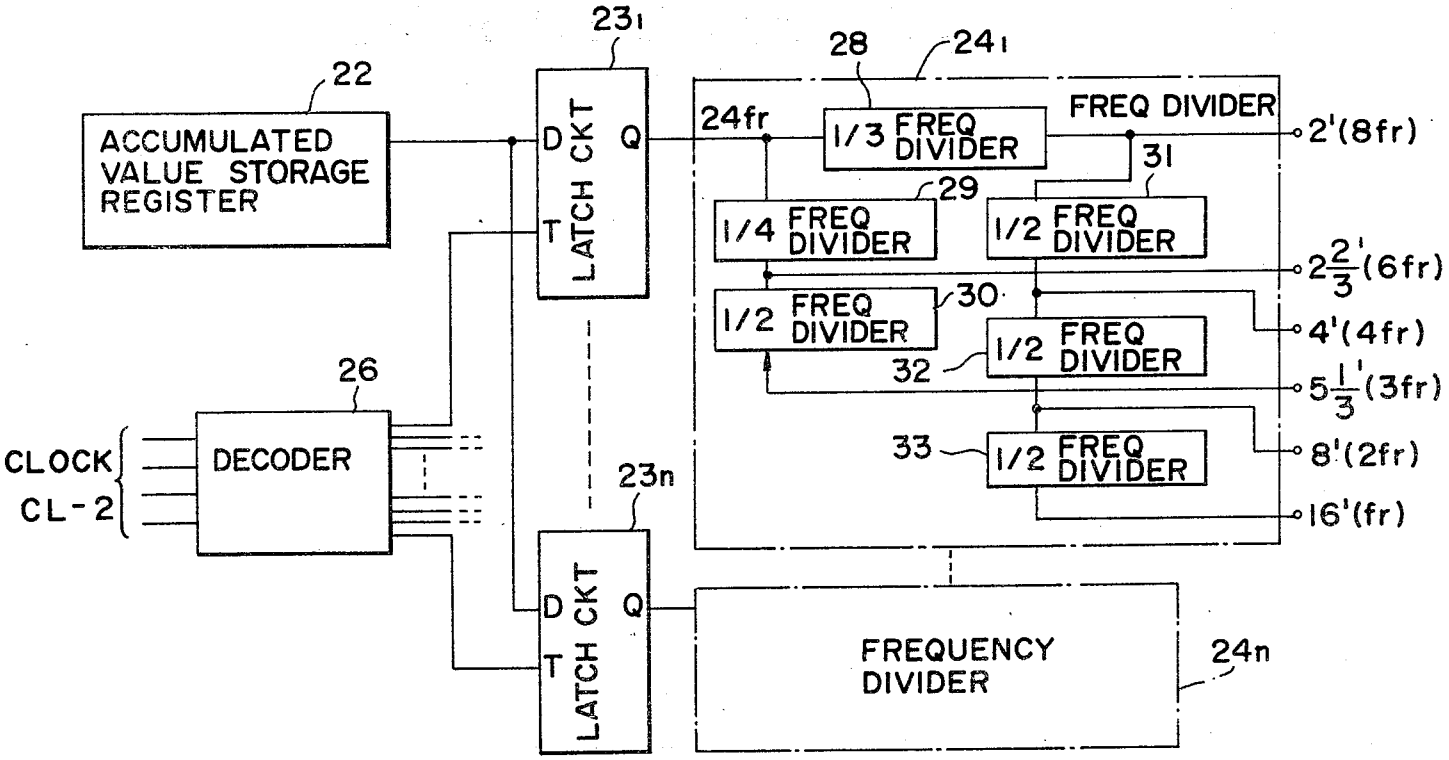
FIG. 11 shows specific operative examples of a latch circuit and a frequency divider utilized in the embodiment of FIG. 9.

FIG. 11 illustrates specific operative examples of the latch circuits $23_1$ to $23_n$ and the frequency dividers $24_1$ to $24_n$ employed in the second embodiment of FIG. 9, and FIGS. 12*a* to *c* show their operating waveforms.

Figure 12:
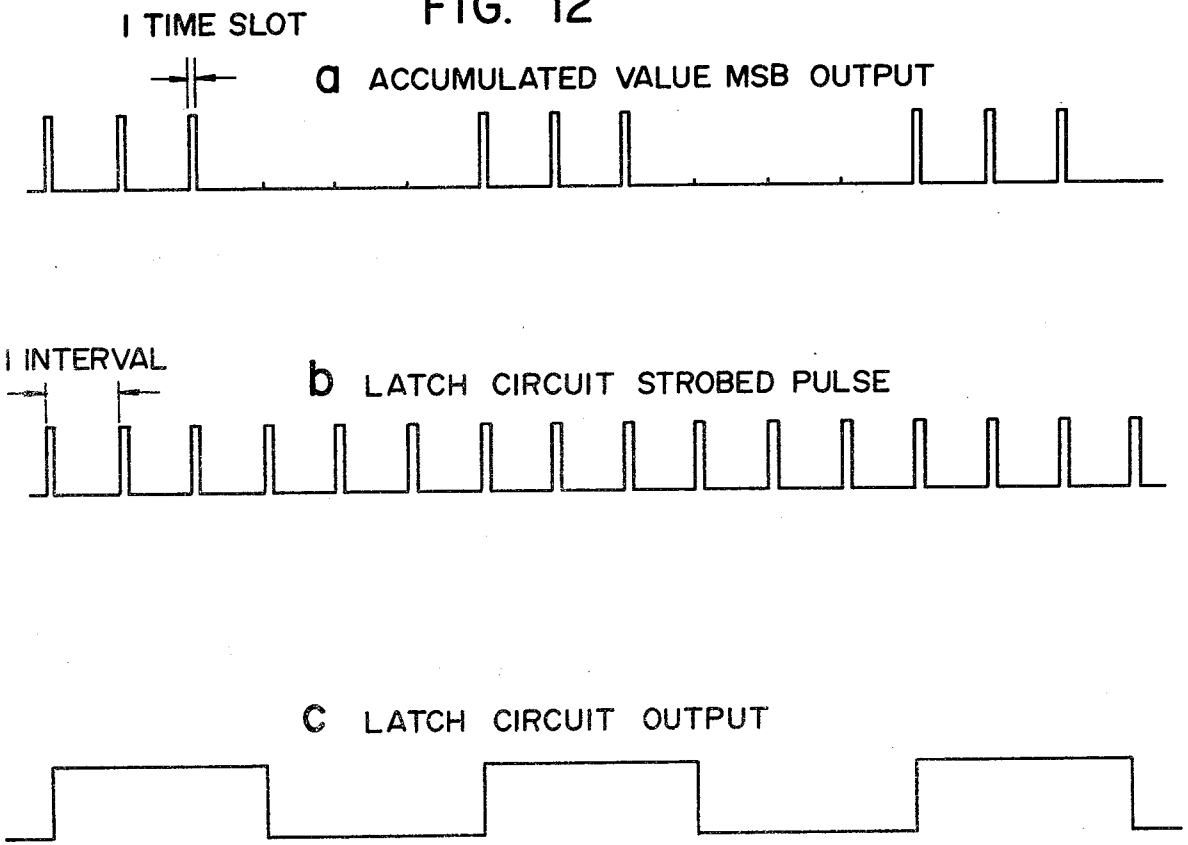
FIGS. 12*a, b* and *c* show operating waveforms in FIG. 11.

In FIG. 11, the 16-foot tone output which is the most significant bit output from the accumulated value storage register 22 is applied to a D terminal of each of the latch circuits $23_1$ to $23_n$, each formed by a D flip-flop, and the sequence pulse from the decoder 26 is provided to the T terminal of each latch circuit; in this case, the sequence pulse is applied as a strobe signal in the time slot assigned to the corresponding channel. Consequently, for example, that data in the most significant output which is for the time slot of FIG. 12*a* corresponding to the channel 1 is designated by a strobed pulse of FIG. 12*b* for each interval and stored in the latch circuit $23_1$. As a result of this, there is produced from the latch circuit $23_1$ such a Q output waveform as shown in FIG. 12C.

Accordingly, the latch circuit $23_1$ serves to take out from the time division multiplex signal a rectangular wave pulse of the channel being selected.

The thus shaped rectangular wave pulse taken out from the time division signal is led to the frequency divider $24_1$ of the channel 1 which is exemplified in FIG. 11 for convenience of description. At this time, the rectangular wave pulse has a frequency of 24 $f_T$ in relation to the expressions (2) and (4).

In the frequency divider $24_1$, the rectangular wave pulse of the frequency 24 $f_T$ is once frequency divided by a 1/3 frequency divider 28 to take out 2' (8 $f_T$), which is applied to $\frac{1}{2}$ frequency dividers 31, 32 and 33 one after another to derive therefrom 4' (4 $f_T$), 8' (2 $f_T$) and 16' ($f_T$), providing a rectangular wave pulse of the $2^n$-feet tones. That is to say, the 16-foot tone is frequency divided down to 1/24 to obtain a frequency $f_T$.

The quint note is obtained by repeatedly frequency dividing the frequency 24 $f_T$ down to $\frac{1}{2}$; namely, the rectangular wave pulse of the frequency 24 $f_T$ is applied to a 1/4 frequency divider 29 to obtain $2\frac{2}{3}'$ (6 $f_T$), which is, in turn, applied to a $\frac{1}{2}$ frequency divider 30 to provide $5\frac{1}{3}'$ (3 $f_T$).

The rectangular wave pulses of the $2^n$-feet and quint notes 2', $2\frac{2}{3}'$, 4', $5\frac{1}{3}$, 8' and 6' thus derived from the latch circuits $23_1$ to $23_n$ and the frequency dividers $24_1$ to $24_n$ corresponding to the respective channels are applied to tone filters $25_1$, $25_2$, $25_3$, $25_4$, $25_5$ and $25_6$ respectively corresponding to the abovesaid feet ratios, in which the rectangular waves are shaped and combined into a composite signal, which is provided to a sound system 27.

In the present embodiment, any key code for selecting the kind of keyboard is not introduced for the sake of brevity; but, in the case of using a plurality of keyboards, it is possible, by the prior art, to introduce key code which is introduced together with the note code and the octave code and combine them by time division processing.

Further, in this second embodiment, the note code and the octave code are applied together to the phase coefficient memory 15 from the key switch detecting and assigning circuit 14, but it is also possible to apply only the note code to the phase coefficient memory 15 and provide the octave code to the frequency dividers $24_l$ to $24_n$ for octave division.

As described above, according to the second embodiment, a unit phase coefficient corresponding to a note code required by a key depression is read out from a phase coefficient memory of a tone generating part for each time division channel to obtain an accumulated value; predetermined bits of the accumulated value are taken out and are each stored in a latch circuit for each time divisoin channel; and the output signals from the latch circuits are respectively frequency divided by predetermined frequency divider groups to provide tone source signals. This eliminates the possibility of some circuits being idle as described previously in respect of FIG. 1 and permits simultaneous generation of the rectangular wave pulses of the quint note and the $2^n$-feet tones which is difficult to effect in the first embodiment shown in FIG. 5. Furthermore, in the second embodiment, the latch circuits are provided as rectangular waveform memories respectively corresponding to the channels, so that such sampled pulse removing means as described previously in connection with the first embodiment is unnecessary and the amplitude of the rectangular wave is not reduced. However, as compared with the first embodiment, the latch circuits and the frequency dividers inevitably introduce complexity in the entire circuit construction.

Figure 13:
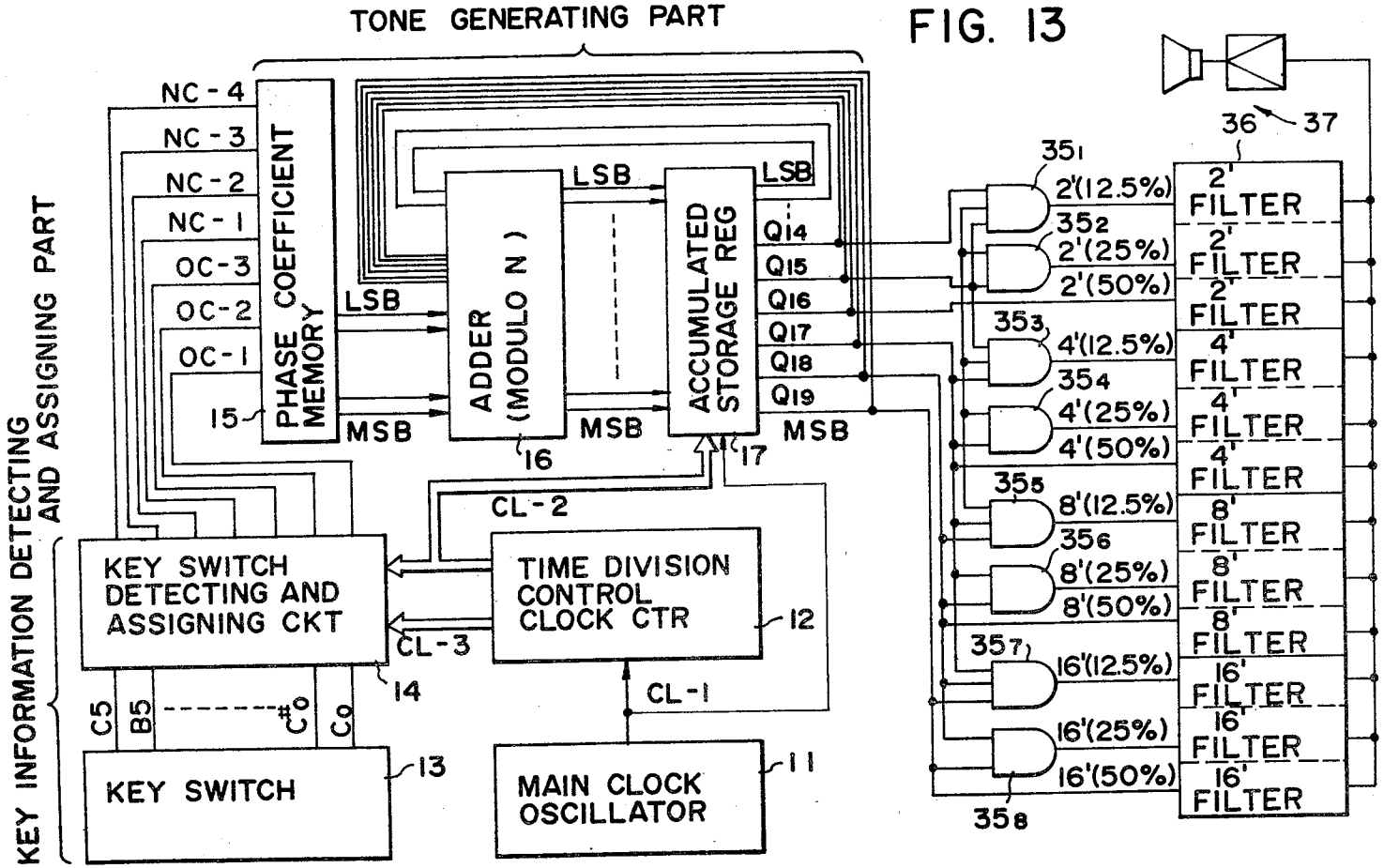
FIG. 13 is a block diagram illustrating still another embodiment of this invention.

FIG. 13 illustrates a third embodiment of the present invention. In the foregoing embodiment, the unit phase coefficient corresponding to the note code of the key being depressed is stored in the phase coefficient memory of the tone generating part and read out therefrom and accumulated by the accumulator for each time division channel, and higher order bits of the accumulated value are taken out and applied to. A demultiplexer for taking out higher order bits of the accumulated value and supplying them as a sampled rectangular wave signal to a filter provided corresponding to each key, the filter eliminates a sampling pulse component from the sampled rectangular wave, and a mixing circuit them mixes the output from the filters. This arrangement has the advantage of markedly simplified construction of the tone generating part. However, since the higher order bits of the binary code of the accumulated value are taken out to produce the rectangular sampled waveform, only a rectangular wave of a 50% duty ratio is generated theoretically. As is well-known in the art, the rectangular wave of the 50% duty ratio contains odd harmonics alone and does not contain even harmonics.

In the case of simulating a desired musical instrument note by applying to a tone filter the rectangular sampled waveform of such a harmonic composition, the simulation is difficult due to the lack of the even harmonic components in many cases.

In the third embodiment of FIG. 13, the arrangements of the key information detecting and assigning part and the tone generating part and the functions of their circuits are identical with those described previously in connection with the embodiments of FIGS. 2 and 9; therefore, no detailed description will be repeated.

With the arrangement of the accumulator used in the foregoing embodiment, however, since the selection of the feet ratio is effected by the selection of the higher order bits of the accumulated value, the resulting rectangular wave is of the $2^n$-feet tones and its duty ratio is 50%.

In the third embodiment, there is provided a duty converter formed by logical circuits, as shown in FIG. 13. Each of the higher order bits of the accumulated value is combined with two lower order bits. For example, the accumulated values $Q_{19}$, $Q_{18}$ and $Q_{17}$ in FIG. 5 are combined; in this case, the value $Q_{19}$ is outputted directly, and the other values $Q_{19}$ and $Q_{18}$ are outputted via an AND circuit $35_8$ and the values $Q_{19}$, $Q_{18}$ and $Q_{17}$ are outputted via an AND circuit $35_7$, thus obtaining rectangular wave sampled pulses of the feet ratios 16′ (50%), 16′ (25%) and 16′ (12.5%), respectively. In a similar manner, the accumulated values $Q_{16}$, $Q_{15}$ and $Q_{14}$ are combined; in this case, the value $Q_{16}$ is outputted directly, and the values $Q_{16}$ and $Q_{15}$ are outputted via an AND circuit $35_2$ and the values $Q_{16}$, $Q_{15}$ and $Q_{14}$ are outputted via an AND circuit $35_1$, thus obtaining rectangular wave sampled pulses respectively having feet ratios 2′ (50%), 2′ (25%) and 2′ (12.5%). These rectangular wave sampled pulses thus obtained are applied to respectively corresponding filters of a tone filter group 36 in which they are shaped by the low-pass characteristics of respective tones, and the resulting outputs are applied as a composite output to a sound system 37.

FIGS. 14*a* to *f* are explanatory of the operation of the duty converter employed in the third embodiment.

Figure 14:
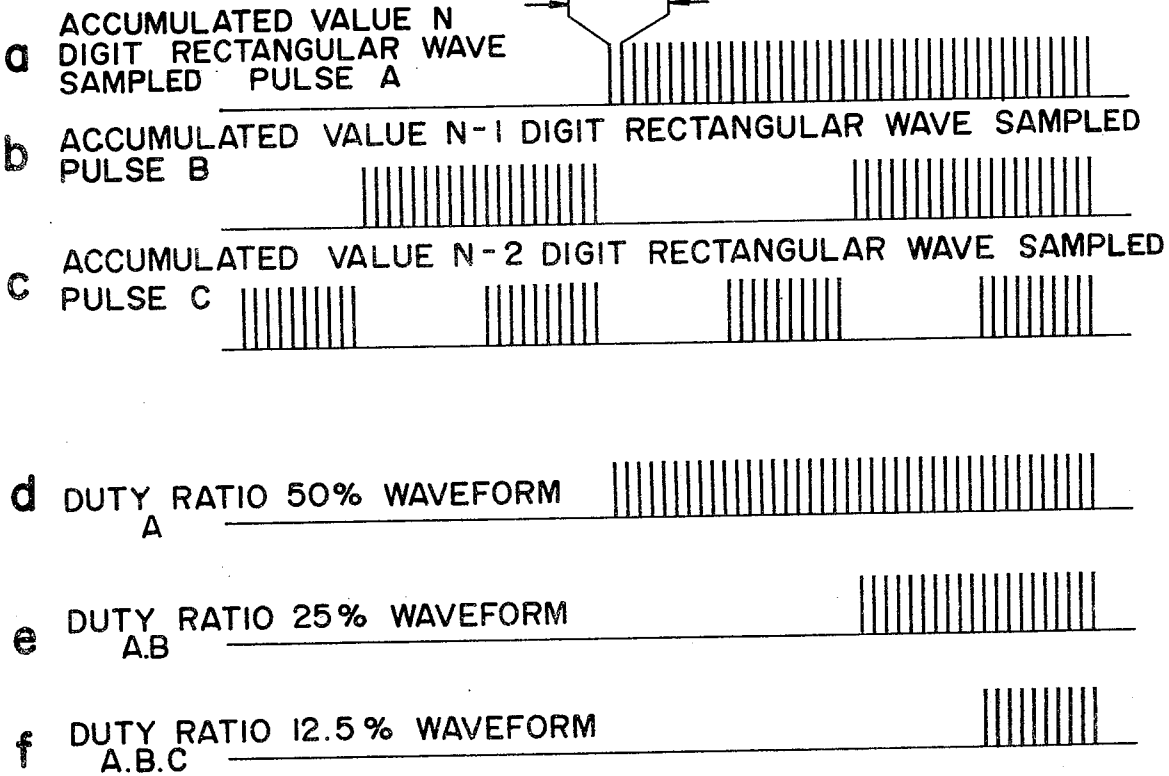
FIGS. 14*a* to *f* are explanatory of the operation of a duty ratio changing circuit used in the embodiment of FIG. 13.

Letting the three digits of the accumulated value output be represented by N, N-1 and N-2, respectively, and showing them by waveforms A, B and C in FIGS. 14 *a* to *c*, the waveform of the 50% duty ratio shown in FIG. 14*d* is identical with the rectangular wave sampled pulse A of FIG. 14*a* because the latter is outputted directly. The 25% duty ratio of a waveform shown in FIG. 14*e* is resulted by obtaining the logical product of the rectangular sampled pulses A and B of FIGS. 14*a* and *b*; and the 12.5% duty ratio of a waveform shown in FIG. 14*f* is resulted by obtaining the logical product of the rectangular wave sampled pulses of FIGS. 14 *a*, *b* and *c*.

In the above, the description has been made of duty ratios up to 12.5%, but if the number of digits is increased, then it is possible to obtain rectangular wave sampled pulses of different duty ratios such as 6.25% and 3.125% with an increase in the number of digits used.

Thus, even if the rectangular wave is such a time division multiplexed rectangular wave, that is, a rectangular wave sampled at regular intervals, its duty ratio can be converted by combining a plurality of outputs through the use of logical circuits.

The third embodiment has described above with regard to one time division channel, but it is needless to say that the method of this embodiment is also applicable to simultaneous generation of a plurality of time division multiplexed notes.

As described above, according to the third embodiment, a rectangular wave sampled pulse of a 50% duty ratio is applied from higher order digits of a tone source circuit of an electronic musical instrument to a duty ratio converter composed of AND circuits to derive therefrom rectangular wave sampled pulses of various duty ratios. This makes it possible to contain even harmonics in rectangular wave pulse signal which has heretofore been difficult to achieve; hence, it is easy to simulate a desired instrument note. Especially, the duty ratio converter comprises a combination of simple AND circuits and the serial time division multiplex signals need not be converted into parallel form, so that the overall structure is markedly simplified and hence can easily be fabricated as a large scale integrated circuit, making it possible to obtain a small, inexpensive tone source circuit.

It will be apparent that many modifications and variations may be effected without departing from the scope of the novel concepts of this invention.

What is claimed is:

1. A tone source circuit for electronic musical instruments, comprising:

a note assignor having a plurality of time division channels for assigning to a selective one of said channels a note code corresponding to a depressed key of the electronic musical instrument;

a phase coefficient memory which is supplied with the note code and from which a unit phase coefficient corresponding to the note code is read out for each time division;

an accumulator comprising an adder and an accumulated value storage register, said adder being supplied with the unit phase coefficient and with the value from the accumulated value storage register and provides the results of the addition as a new value to the accumulated storage register, to output from the accumulated value storage register an accumulated value of a series of ordered bits for each time division channel; and a demutiplexer output device for taking out higher order bits for accumulated value and combining them as a rectangular wave signal to output a composite tone source signal.

2. A tone source circuit for electronic musical instruments comprising:

a note assignor having a plurality of time division channels for assigning to a selective one of said channels a note code corresponding to a depressed key of the electronic musical instrument;

a phase coefficient memory which is supplied with the note code and from which a unit phase coefficient corresponding to the note code is read out for each time division;

an accumulator comprising an adder and an accumulated value storage register, said adder being supplied with the unit phase coefficient and with the value from the accumulated value storage register and provides the results of the addition as a new value to the accumulated storage register, to output from the accumulated value storage register an accumulated value of a series of ordered bits for each time division channel;

a latch circuit group for latching predetermined bits of the accumulated value for each time division channel;

a frequency divider group for frequency dividing output signals from the latch circuit group by predetermined frequency dividing ratios; and a mixing device for combining the outputs from the frequency divider group to output a composite tone source signal.

3. A tone source circuit for electronic musical instruments, comprising:

a note assignor having a plurality of time division channels for assigning to a selective one of said channels a note code corresponding to a depressed key of the electronic musical instrument;

a phase coefficient memory which is supplied with the note code and from which a unit phase coefficient corresponding to the note code is read out for each time division;

an accumulator comprising an adder and an accumulated value storage register, said adder being supplied with the unit phase coefficient and with the value from the accumulated value storage register and provides the results of the addition as a new value to the accumulated storage register, to output from the accumulate value storage register an accumulated value of a series of ordered bits for each time division channel; and a duty ratio converter supplied with and suitably combining a plurality of bits of the accumulated value having octave relationships with one another each bit representing a rectangular wave sampled pulse signal of a 50% duty ratio, such that the output from the converter are rectangular wave sampled pulses of different duty ratios.

4. A tone source circuit according to claim 3, wherein the duty ratio converter is composed of AND circuits which are supplied with rectangular wave sampled pulses of the 50% duty ratio from a plurality of digits of the accumulated value having octave relationships to one another.

* * * * *